US006749490B1

(12) United States Patent
Hafenrichter

(10) Patent No.: US 6,749,490 B1
(45) Date of Patent: Jun. 15, 2004

(54) PORTABLE NUMERICALLY CONTROLLED WATER-JET DRILLER

(75) Inventor: Joseph Hafenrichter, Redmond, WA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 82 days.

(21) Appl. No.: 10/147,475

(22) Filed: May 16, 2002

(51) Int. Cl.[7] ..... B24C 3/00
(52) U.S. Cl. ..... 451/75; 451/2; 51/295
(58) Field of Search ..... 451/2, 75, 90, 451/102; 51/295; 29/39

(56) References Cited

U.S. PATENT DOCUMENTS 4,286,417 A * 9/1981 Shelton ..... 451/2
4,708,214 A * 11/1987 Krawza et al. ..... 175/424
4,955,164 A * 9/1990 Hashish et al. ..... 451/40
5,081,800 A * 1/1992 Ruholl ..... 451/2
5,399,968 A 3/1995 Sheppard et al.
5,404,641 A 4/1995 Bratten et al.
5,535,496 A * 7/1996 Sugino et al. ..... 29/39
5,542,796 A 8/1996 Bratten et al.
5,725,698 A 3/1998 Mahoney
5,927,329 A * 7/1999 Yie ..... 137/624.13
2003/0109206 A1 * 6/2003 Anand et al. ..... 451/90

* cited by examiner

*Primary Examiner*—Lee D. Wilson
(74) *Attorney, Agent, or Firm*—Mark O. Glut

(57) ABSTRACT

A portable numerically controlled ("N/C") water-jet driller for drilling a hole through skin and substructure of structures, which includes an agile water-jet driller end effector and a numerically controlled apparatus for placing the water jet driller end effector within a region of the hole to be drilled. The N/C apparatus communicating with the agile water-jet driller end effector.

14 Claims, 5 Drawing Sheets

PORTABLE NUMERICALLY CONTROLLED WATER-JET DRILLER

STATEMENT OF GOVERNMENT INTEREST

The invention described herein may be manufactured and used by or for the Government of the United States of America for governmental purposes without payment of any royalties thereon or therefor. This invention was invented under contract number N00019-97-C-0037 with the Boeing Company.

BACKGROUND

The present invention relates to a mechanism for drilling holes, specifically aerospace and aircraft structure holes. More specifically, the present invention relates to a portable numerically controlled (N/C) water-jet driller.

Aerospace and aircraft structures contain numerous pre-drilled holes, specifically fastener holes, which are drilled through the skin and substructure. These holes must be accurately located and have excellent finish quality in order to meet the stringent requirements necessary for structural fastening in aircraft and aerospace applications.

Current hole drilling devices pose several problems and difficulties. These problems include slow drilling rates, mislocated hole position, and high capital and facilities costs. These drilling devices include N/C drill towers, pneumatic feed drill motors and backup-tooled drilling machines.

N/C drill towers are numerically controlled drilling machines that are large, vertical mills on massive tracks that drill fastener holes in airframe structures. Several brands of N/C drill towers are available, such as the Jobes™ driller (known as the precision drill center), which is currently utilized to drill F-22 wing skins. Though highly accurate, these machines have slow drilling rates, while requiring large capital investments and extensive facilities modifications. Drilling rate is typically defined, but without limitation, as the quantity of holes that can be drilled per hour (including time allocated for part fixturing, driller alignment, teardown and maintenance.) The drilling rate with N/C drill towers is further reduced when structural deflection caused by drilling forces acting against the structure being drilled limits the drilling force that the machine can impart to the structure being drilled (thereby limiting drilling rate).

Pneumatic feed drill motors are devices that are hand aligned into drill guides or drill templates that position the drill motor over the intended hole location. Typical models utilized on an aerospace or aircraft production floor are the Spacematic™, Peck™, and Quackenbush™ drill motors. Pneumatic feed drill motors suffer from slow drilling rates, mislocated and poor quality holes.

Backup-tooled drilling machines are numerically controlled and can drill accurate, high quality holes. These machines also have fast drilling rates because the high drilling forces are nullified by a movable backup structure that is repositioned for each hole by the drilling machine. Production backup-tooled drilling machines include the Electro-impact™ (used on the Boeing 737™) and Flexible Assembly System (used on the Boeing F/A-18E/F). The primary limitations of this type of driller are high capital costs, high maintenance costs, excessive floor space, U & O costs, and long procurement and facilities lead times.

Other types of drilling machines or methods such as high power lasers that remove material with heat or thermal energy, cause mechanical stresses on the cut surface and can emit hazardous materials or vapors.

For the foregoing reasons, there is a need for a new portable N/C water-jet driller.

SUMMARY

The instant invention is directed to a portable N/C water-jet driller that satisfies the needs enumerated above and below.

The present invention is directed to a portable N/C water-jet driller. The portable N/C water-jet driller includes an agile water-jet driller end effector and a numerically controlled apparatus for placing the water-jet driller end effector within a region of the hole to be drilled. The agile water-jet driller end effector communicates with the numerically controlled apparatus.

It is an object of the invention to provide a portable N/C water-jet driller that can drill fast, accurate, high quality holes with reduced capital, maintenance and facilities costs.

It is an object of the invention to provide a portable N/C water-jet driller that does not require excessive floor space.

It is an object of the invention to provide a portable N/C water-jet driller that improves the assembly process, particularly the assembly process of aircraft, by greatly reducing the drilling forces required to create fastener holes.

It is an object of the invention to provide a portable N/C water-jet driller that does not require an indexing tool. Indexing tools are typically defined as hard templates or drill guides that guide the location of the hole on the structure being drilled.

It is an object of the invention to provide a portable N/C water-jet driller that combines the invasive drilling capability of a water-jet cutter with the labor savings of a numerically controlled machine.

It is an object of the invention to provide a portable N/C water-jet driller that does not utilize or emit any noxious gases or liquids and does not create hazardous materials or vapors. It is another object of the present invention to provide a portable N/C water-jet driller that removes material using a non-thermal process.

It is an object of the invention to provide a portable N/C water-jet driller that allows most fixturing tools to be eliminated because the driller imparts virtually no deflecting force during drilling. Fixturing tools are rigid devices that are usually permanently floor mounted that have precisely machined features that captivate or clamp structural components into precise 3-dimensional orientations. Generally, lower drill forces allow for small, lightweight, less expensive fixturing tools.

It is an object of the invention to provide a portable N/C water-jet driller that does not leave any heat-affected zones or mechanical stresses on the cut surface.

These and other features, aspects and advantages of the present invention will become better understood with reference to the following description and appended claims, and accompanying drawings wherein:

DESCRIPTION

Figure 1:
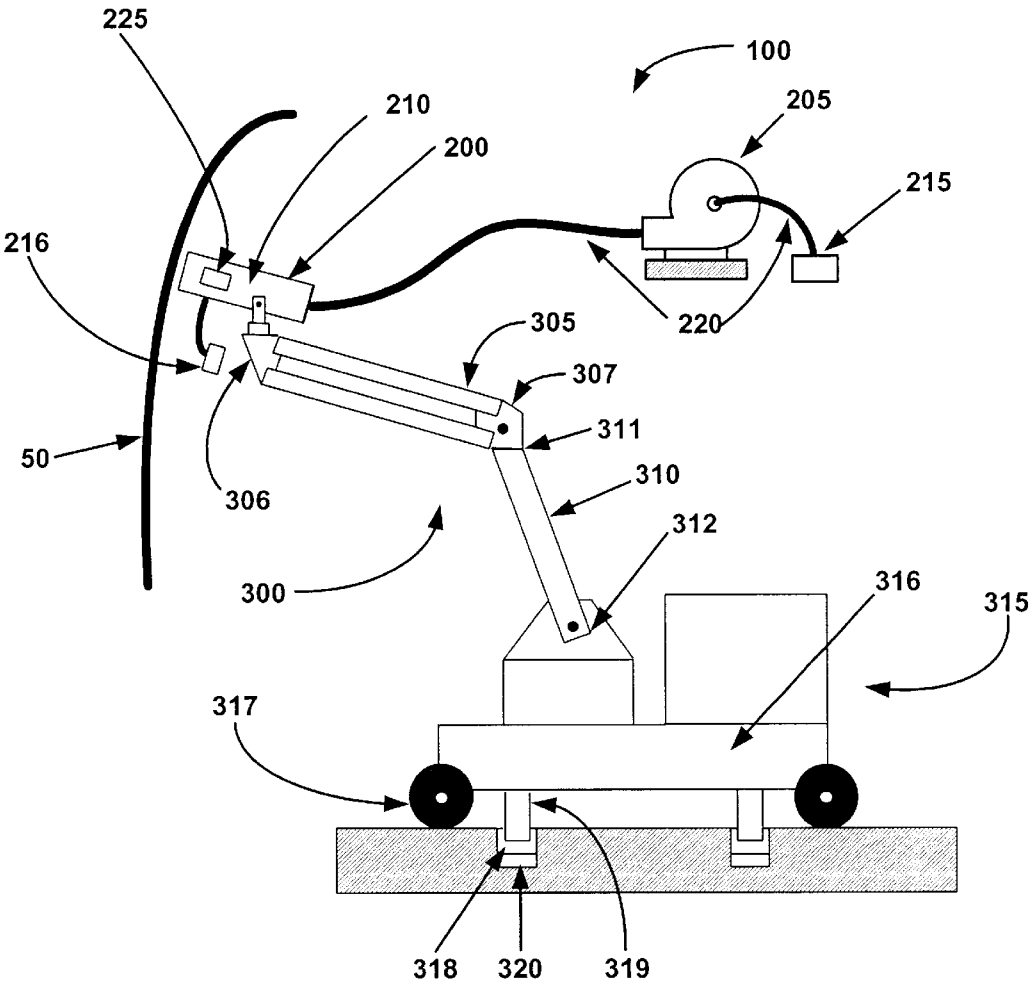
FIG. 1 is a side view of one of the embodiments of the portable N/C water-jet driller in operation on a concave surface.

The preferred embodiments of the present invention are illustrated by way of example below and in FIGS. 1, 2, 3, 4 and 5. As seen in FIG. 1, a portable numerically controlled ("N/C") water-jet driller 100 includes an agile water-jet driller end effector 200 and a numerically controlled ("N/C") apparatus 300.

In the discussion of the present invention, the invention will be discussed in an aircraft and aerospace environment, specifically for use on the skin of an aircraft, however, the invention can be utilized on other types of structures, materials or items such as, but without limitation, vehicles, ships, submarines, buildings, machines, and the like.

Figure 2:
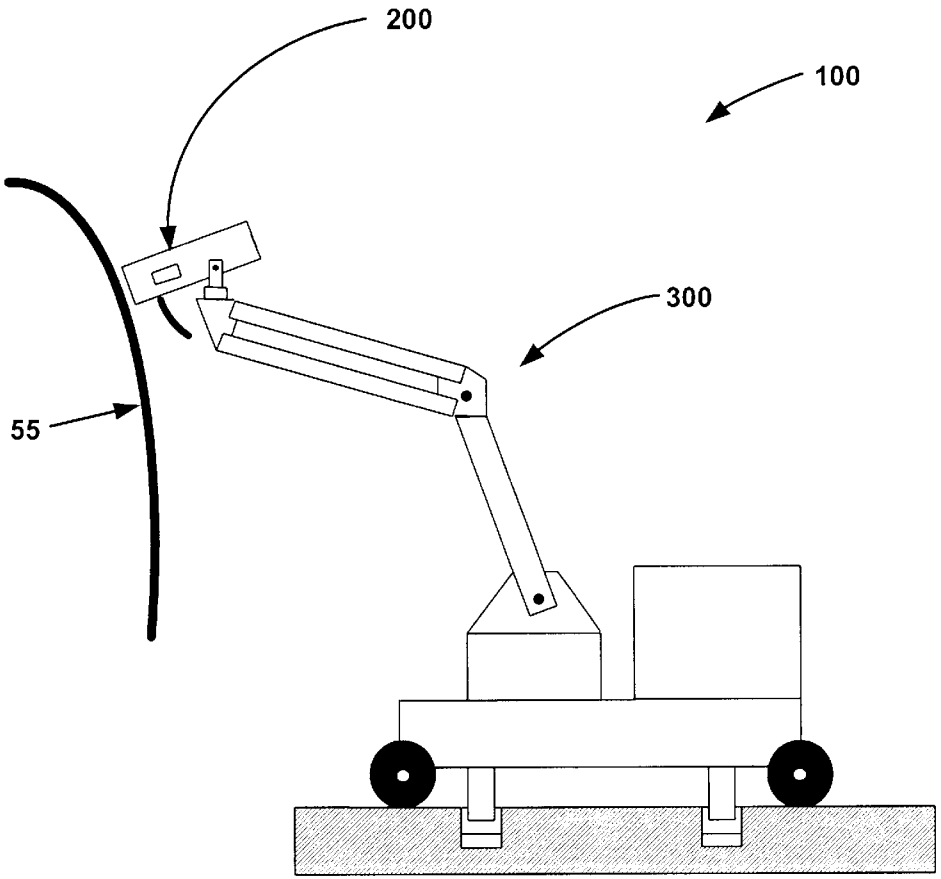
FIG. 2 is a side view of one of the embodiments of the portable N/C water-jet driller in operation on a convex surface.

As seen in FIGS. 1 and 2, the portable N/C water jet driller 100 may be utilized, but without limitation, on a concave-like airframe skin 50 (i.e. inside of an airframe), a convex-like airframe skin 55 (i.e. outside of an airframe), or any other type of substructure. The portable N/C water-jet driller 100 can be used to cut almost any type of hole, for example, but without limitation, a fastener hole, which is drilled through the skin and substructure of aircraft or aerospace structures.

An agile water-jet driller end effector 200 is, but without limitation, a movable apparatus or machine that causes a hole or aperture to appear, be cut, be drilled, be bored, or be pierced on a structure or substructure, particularly through a skin of an aircraft or aerospace structure. The agile water-jet driller end effector 200 utilizes a water-jet to cut the hole or aperture.

Typically, the agile water-jet driller end effector 200 is a water-jet cutter, which uses ultra high-pressure water as a cutting tool. Typically the term "ultra high-pressure" is defined as more than about 30,000 pounds per square inch (psi). For a metallic skin or substructure the preferred pressure is more than about 60,000 psi. In water-jet cutting, the removal process can be described as a supersonic erosion process. The stream velocity, usually greater than the speed of sound, tears away microscopic pieces or grain material. The agile water-jet driller end effector 200 utilizes a focused beam of water at high velocity, which has enormous cutting power.

Essentially there are two types of water-jet cutters: pure water-jet and abrasive water-jet. Pure water-jets utilize only water, while abrasive water-jets utilize water with abrasive particles dispersed within the water-stream. Typically the abrasive water-jet cuts harder materials such as metals, metal alloys, stones, composites and ceramics. Abrasive water-jets are preferred and are more effective on aircraft and aerospace structures, which are typically primarily metallic or composite in nature.

An agile water-jet driller end effector 200 may contain a cutting head 210 (with a jewel nozzle 209) and plumbing 220. The agile water-jet driller end effector 200 may be in fluid communication with a pump 205. Plumbing 220, which may be tubing, allows communication between the elements of the agile water-jet driller end effector 200 and any other elements. A pump 205 is typically defined, but without limitation, as an apparatus or machine for moving or altering the pressure of fluids in confined spaces. In operation, water flows from a water source 215 through plumbing 220, through the pump 205 (which increases the pressure of the water), through other plumbing 220 and into the cutting head 210. Once inside the cutting head 210, the energy of the high-pressure water is transformed into high velocity flow as the cutting head 210 directs its path. The water exiting the cutting head 210 is then used to cut the material or work piece.

The cutting head 210 may also include a mixing tube 225. The mixing tube 225 may be a tube, cylinder or apparatus where abrasive is mixed with water immediate after entering the cutting head 210. The mixing tube 225 may be in fluid communication with the water source 215 to accept the water and in communication with an abrasive source 216 to accept the abrasive.

The abrasive used in abrasive water-jets is typically hard sand; however, steel shot, lead shot, or any high density or highly abrasive material may be used. The most common abrasive used is garnet. Garnet is typically defined as any of the group of hard, vitreous minerals, silicates of calcium, magnesium, iron, or manganese with aluminum or iron varying in color. Different mesh sizes are used for different applications. The preferred mesh size for aircraft and aerospace applications is in the range from about 50 mesh to about 120 mesh (similar to sand paper). Mesh is typically defined as a unit of measurement that defines the number of openings or particles per linear inch. Larger number mesh (finer abrasives) produce slower cuts and smoother surfaces.

Figure 3:
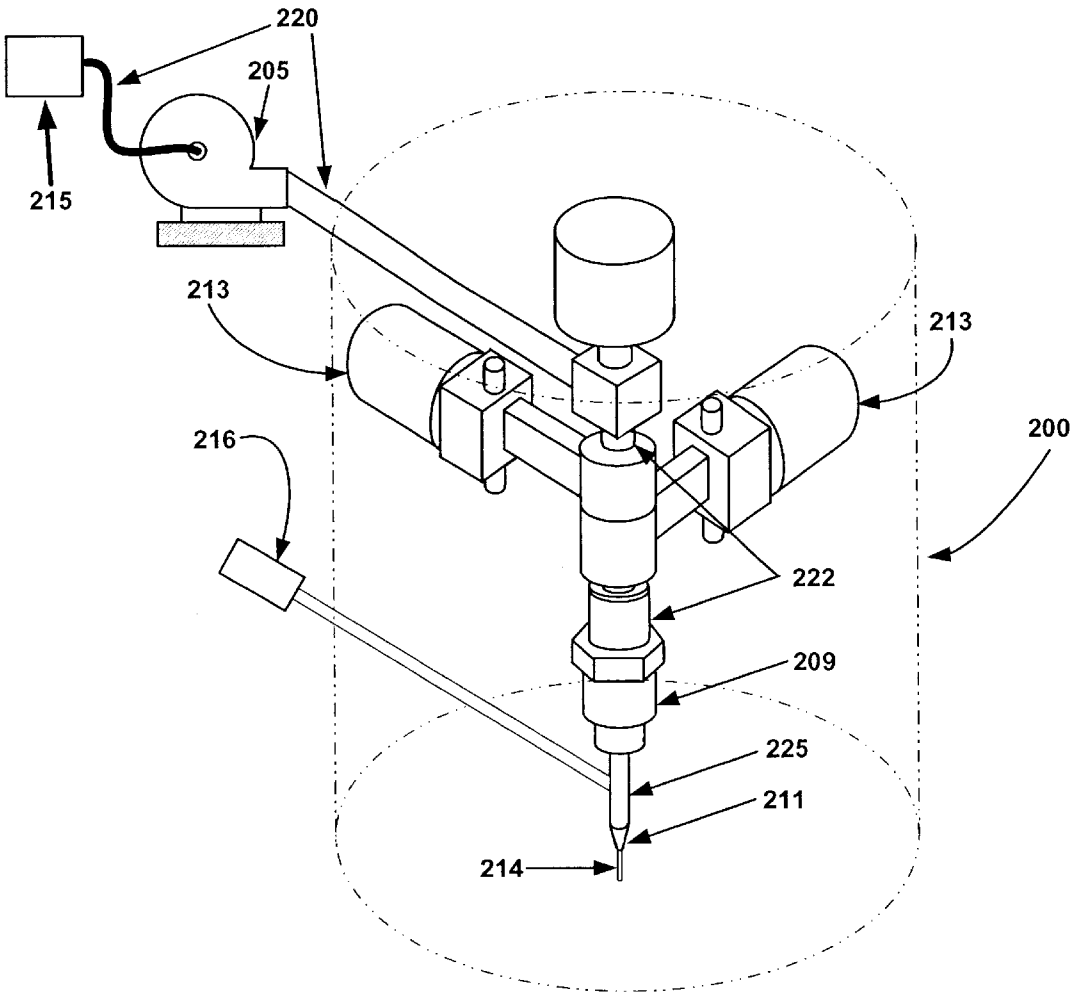
FIG. 3 is a detailed view of one of the embodiments of the agile water-jet driller end effector.

One embodiment of the internal workings of the agile water-jet driller end effector 200 is shown in FIG. 3. These internal workings may be disposed within a housing. As shown in FIG. 3, the agile water-jet driller end effector 200 may include a dorsal assembly 222, a nozzle 209, a mixing tube 225 and plumbing 220. The dorsal assembly 222 is in communication with the nozzle 209, while the nozzle 209 is in communication with the mixing tube 225. In one of the embodiments, the dorsal assembly 222, the nozzle 209, and the mixing tube 225 may all be included within the apparatus of the cutting head 210. In addition, as seen in FIG. 3, the dorsal assembly 222, the nozzle 209, and the mixing tube 225 may be axially aligned. In operation, in this embodiment, water flows through the plumbing 220 into the dorsal assembly 222 and into the nozzle 209. Once inside the nozzle 209, the energy of the high-pressure water is transformed into high velocity flow. Water from the nozzle 209 and abrasive from an abrasive source 216 are then introduced into the mixing tube 225, after which the abrasive water-jet stream 214 then exits an aperture 211. The aperture 211 may be in fluid communication with the mixing tube 225. The exiting water-jet stream 214 can then cut a hole into the work piece.

In one of the preferred embodiments, as seen in FIG. 3, the precise hole pattern that the agile water-jet driller end effector 200 cuts will be generated by a pair of numerically controlled servos 213. In another embodiment of the invention, one or several numerically controlled servos 213 may be utilized. The numerically controlled servos 213 are in communication with the dorsal assembly 222 such that the numerically controlled servos 213 can move the dorsal assembly. As the numerically controlled servos 213 move the dorsal assembly 222 in a computer coordinated pattern, the servos 213 direct the water-jet stream 214 to cut nearly perfect circular holes. This device can cut any other hole shapes that can be numerically programmed, including, but not limited to, ovals, rectangles, squares and octagons.

The cutting head 210, specifically the nozzle 209, may be manufactured from any hard material that resists erosion from a water-stream. For example, but without limitation, the cutting head 210 or nozzle 209 may be manufactured from a crystal jewel, sapphire, ruby, or diamond. A sapphire is typically a native, blue gem corundum (a corundum is a hard native or artificial aluminum oxide). A ruby is typically a red variety of corundum. An artificial ruby can also be used to manufacture the cutting head 210 or nozzle 209. An artificial ruby may be made by fusing chromium sesquioxide and powdered alumina. A diamond is typically a crystalline carbon, colorless or tinted isometric crystals that are insoluble and nonfusible and burning to carbon dioxide. Industrial diamonds may be used for the cutting head 210 or nozzle 209, especially synthetic diamonds made by heating graphite and carbon black with a tantalum catalyst at 1600 degrees Celsius and 95,000 atmospheres.

A numerically controlled apparatus 300 is used for placing the water-jet driller end effector 200 within a region of the hole to be drilled. The numerically controlled apparatus 300 is defined, but without limitation, as a computer controlled mechanical device, which accurately maneuvers and holds a payload (such as the agile water-jet driller end effector 200) to programmed positions in 3-dimensional space. The numerically controlled apparatus 300 may be a robot, or any machine or mechanical device that operates automatically with human-like or better than human-like skill.

The numerically controlled apparatus's 300 function is to place the agile water-jet driller end effector 200 within the region of the hole location. Once the numerically controlled apparatus 300 has locked itself at the hole region, the agile water-jet driller end effector 200 precisely maneuvers the cutting head 210, specifically the dorsal assembly 222 (maneuvered by the numerically controlled servos 213), into the exact location of the fastener hole. The water-jet stream 214 from the cutting head 210, specifically the aperture 211, cuts the fastener hole with less than about three pounds of cutting force. After the hole is cut, the numerically controlled apparatus 300 unlocks itself and moves the agile water-jet driller end effector 200 to next hole region to repeat the process or the numerically controlled water-jet driller 100 is placed in a position suitable for storage.

As seen in FIG. 1, in one of the preferred embodiments, the numerically controlled apparatus 300 is a numerically controlled robot that has a first robot arm 305 and a second robot arm 310. It is to be understood, however, any type of numerically controlled apparatus may be used, in addition to the types described herein. Both the first robot arm 305 and the second robot arm 310 may be a rigid member or structure subject to bending stresses from a direction perpendicular to its length. The first robot arm 305 and the second robot arm 310 may be an arbor, a beam, a branch, a member, a shaft, a spar, or the like. The first robot arm 305 has a first end 306 and a second end 307. The second robot arm 310 has a first tip 311 and a second tip 312 (in certain embodiments the term "tip" and "end" may have substantially similar and possibly identical structure and/or meaning.) In one of the preferred embodiments, the first end 306 of the first robot arm 305 is in communication or pivotally attached to the agile water-jet driller end effector 200, while the second end 307 of the first robot arm 305 is in communication or pivotally attached to the first tip 311 of the second robot arm 310. The second end 307 of the first robot arm 305 and the first tip 311 of the second robot arm 310 may be pivotally attached such that the first robot arm 305 and second robot arm 310 may rotate or oscillate about the communication point of the two robot arms. Pivotally attached objects may be attached by any type of fastener that allows pivotal movement, such as, but not limited to, a pin, a bolt, a coupling, a dowel, a joint, a nail, a bearing assembly, or the like. The second tip 312 of the second robot arm 310 may be in communication or attached to a transport cart 315 or any type of platform or stable structure. The second tip 312 of the second robot arm 310 and transport cart 315 may be pivotally attached such that the second robot arm 310 may rotate or oscillate about the communication point of the second robot arm 310 and transport cart 315. They may be attached by any type of fastener that allows pivotal movement.

The transport cart 315 may include a base 316, a set of wheels 317, and a retracting lag apparatus 318. The set of wheels 317 is attached to the base 316 so that the transport cart 315 may be easily moved along a surface. The retracting lag apparatus 318 may be any apparatus or device that has the ability to hold or maintain the transport cart 315 in a stable and secure position. When retracted, the retracting lag apparatus 318 allows the transport cart 315 to be rolled or moved to another position. As shown in FIG. 1, the retracting lag apparatus 318 may be retracting lag bolts 319 with corresponding floor lag points 320. When not retracted, the retracting lag bolts 319 cooperate with the floor lag points 320 so that the portable N/C water-jet driller 100 is secure and unable to move from a stationary position.

The low drilling forces (less than about three pounds of cutting force) greatly improve the determinant assembly drilling process. Most fixturing tools can be eliminated because the driller imparts virtually no deflecting force during drilling. Now the airframe components can be fixtured to one another using only minimal, lightweight fixturing tools that rely on common indexing features (such as precision locating holes and surfaces) to fixture the components in 3-D space during water-jet drilling.

There is relatively no perpendicular drilling forces during the water-jet drilling operation. This is because the water-jet removes very little material in creating each hole as it cuts only a narrow "treepan" circumferential pattern. The residual plugs are later ejected during the structural cleaning operation with a simple blast of compressed air. Traditional drilling processes machine away all the hole material so that much greater perpendicular drilling forces are required. Measured water-jet cutting forces for this type of application are less than about three pounds while conventional drilling forces range from 200 to 600 pounds.

Figure 4:
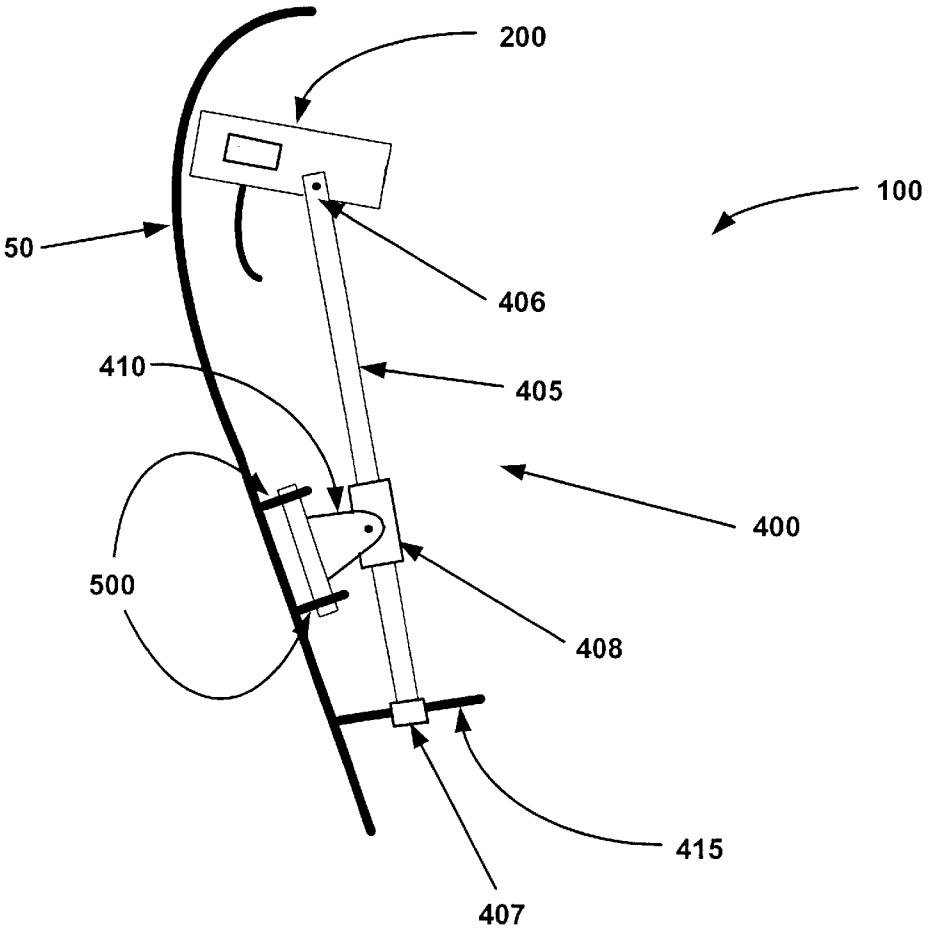
FIG. 4 is side view of one of the embodiments of the mountable application of the portable N/C water-jet driller; and, FIG. 5 is side view of another one of the embodiments of the mountable application of the portable N/C water-jet driller.
Figure 5:
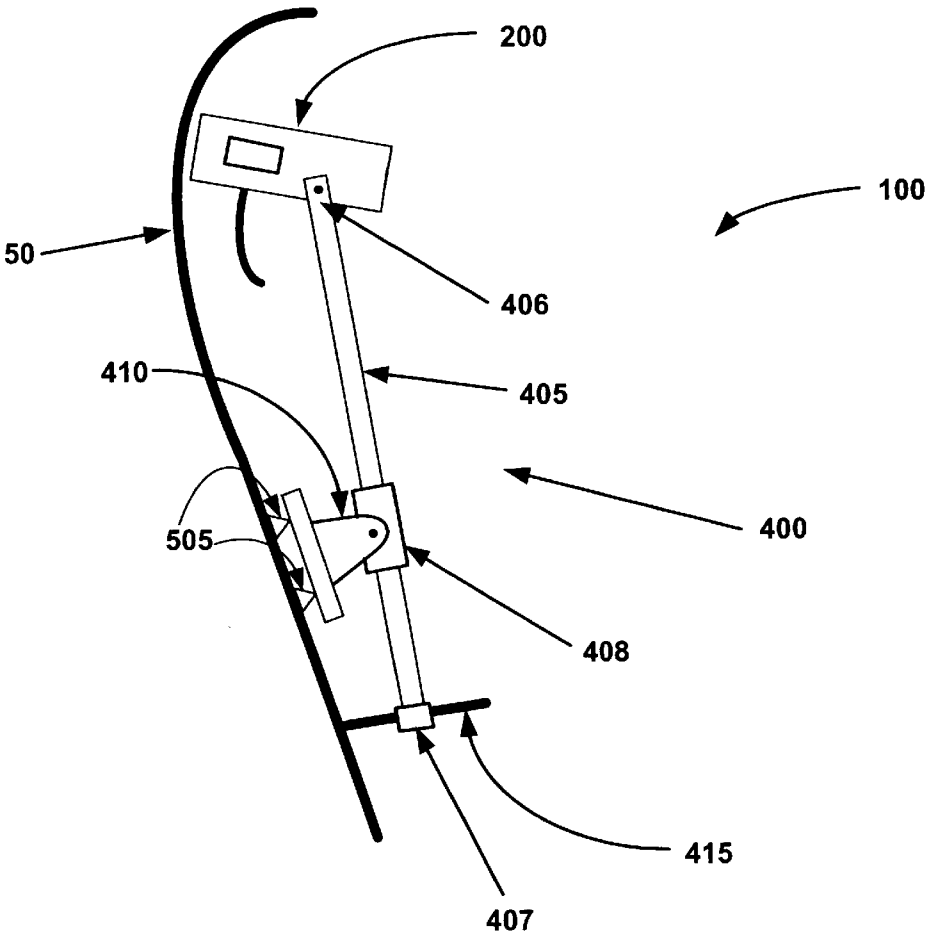

Another embodiment of the portable N/C water-jet driller 100 utilizes a structurally mountable apparatus. FIG. 4 shows one embodiment of a mountable application of the portable N/C water-jet driller 100. In FIG. 4, the agile water-jet driller end effector 200 operates with a structurally mounted rocker apparatus 400. The structurally mounted rocker apparatus 400 may mount to attach points on the airframe 50 itself. The structurally mounted rocker apparatus 400 may be mounted to the airframe 50 in a variety of ways. The attachment points may be predrilled fastener holes that can be filled with temporary standoff anchors 500 to which the portable N/C water-jet driller 100 is mounted. As seen in FIG. 5. another method of mounting is compliant suction cups 505. The suction cups 505 are placed against the airframe skin 50, then the air would be evacuated from underneath the cup thereby creating an immovable attach point that would be used similarly to a structurally mounted attach point. However, it is to be understood that any method of mounting may used. In operation, the rocker apparatus 400 would maneuver the agile water-jet driller end effector 200 to all hole locations within its reach, and then the device would be unmounted, moved and then remounted to drill the next set of fasteners. The apparatus may also mounted onto attach points located on a lightweight fixturing tool.

As seen in FIG. 4, in a preferred embodiment of the portable N/C water-jet driller 100 that utilizes a structurally mountable apparatus, the structurally mounted rocker apparatus 400 includes a rocker apparatus arm 405 and a rocker apparatus base 410. The rocker apparatus arm 405 may have a first end 406 and a second end 407. The first end 406 of the rocker apparatus arm 405 may be in communication with or pivotally attached to the agile water-jet driller end effector 200. The structurally mounted apparatus 400 may also include an arm sleeve 408. The rocker apparatus arm 405 may slide into the arm sleeve 408. The rocker apparatus arm 405 may have the ability to laterally move inside the arm sleeve 408 so that the agile water-jet driller end effector 200 may drill different spots along the aircraft skin 50. As seen in FIG. 4, the rocker apparatus arm 405 may be pivotally attached to the rocker apparatus base 410 via the arm sleeve 408 at a point between the first end 406 and second end 407 of the rocker apparatus arm 405. In one of the embodiments, the rocker apparatus base 410 is in communication with or attached to the temporary standoff anchors 500, which are in communication or attached to the aircraft skin 50. The second end 407 of the rocker apparatus arm 405 may be in communication with or attached to a stabilizing bar 415. The stabilizing bar 415 may be in communication with the aircraft skin 50. The stabilizing bar 415 may have the ability to maintain physical contact with the aircraft skin 50 at all times.

When introducing elements of the present invention or the preferred embodiment(s) thereof, the articles "a," "an," "the" and "said" are intended to mean there are one or more of the elements. The terms "comprising," "including," and "having" are intended to be inclusive and mean that there may be additional elements other than the listed elements.

Although the present invention has been described in considerable detail with reference to certain preferred versions thereof, other versions are possible. Therefore, the spirit and scope of the appended claims should not be limited to the description or drawings of the preferred versions contained herein.

What is claimed is:

1. A portable numerically controlled water-jet driller for drilling a hole, the portable numerically controlled water-jet driller comprising:

(a.) an agile water-jet driller end effector wherein water pressure of water exiting the agile water-jet driller end effector is greater than about 30,000 psi, the agile water driller end effector being an abrasive water-jet driller wherein garnet is used as an abrasive;

(b.) a numerically controlled robot for placing the water-jet driller end effector within a region of the hole to be drilled, the numerically controlled robot communicating with the agile water-jet driller end effector, the numerically controlled robot includes a first robot arm and a second robot arm, the first robot arm and the agile water-jet driller end effector pivotally attached, the first robot arm and the second robot arm pivotally attached; and (c.) a transport cart, the second robot arm and the transport cart pivotally attached.

2. The portable numerically controlled water-jet driller of claim 1, wherein the agile water-jet driller end effector comprises of a cutting head and plumbing, the cutting head for creating a water-jet stream, the plumbing allowing for fluid communication between the cutting head and a pump.

3. The portable numerically controlled water-jet driller of claim 2, wherein the cutting head includes a mixing tube for mixing abrasive and water to create an abrasive water-jet stream.

4. The portable numerically controlled water-jet driller of claim 3, wherein the cutting force of the water-jet stream is less than about three pounds.

5. The portable numerically controlled water-jet driller of claim 4, wherein there are substantially no perpendicular drilling forces during the water-jet drilling.

6. The portable numerically controlled water-jet driller of claim 5, wherein the cutting head is manufactured from a material selected from the group consisting of a crystal jewel, sapphire, ruby, and diamond.

7. The portable numerically controlled water-jet driller of claim 5, wherein the cutting head is manufactured from a synthetic diamond made by heating graphite and carbon black with a tantalum catalyst at 1600 degrees Celsius and 95,000 atmospheres.

8. The portable numerically controlled water-jet driller of claim 5, wherein the cutting head is manufactured from an artificial ruby made by fusing chromium sesquioxide and powdered alumina.

9. The portable numerically controlled water-jet driller of claim 8, wherein mesh size of the garnet is from about 50 mesh to about 120 mesh.

10. The portable numerically controlled water-jet driller of claim of claim 9, wherein the cutting head includes a dorsal assembly, a nozzle, the dorsal assembly attached to the nozzle, the nozzle attached to the mixing tube, the agile water-jet driller further comprising a numerically controlled servo for moving the cutting head, the numerically controlled servo communicating with the dorsal assembly.

11. A portable numerically controlled water-jet driller for drilling a hole, the portable numerically controlled water-jet driller comprising:

(a.) an agile water-jet driller end effector wherein water pressure of water exiting the agile water-jet driller end effector is greater than about 30,000 psi and cutting force less than about three pounds, the agile water driller end effector being an abrasive water-jet driller wherein garnet is used as an abrasive, the garnet having mesh size from about 50 mesh to about 120 mesh, the agile water-jet driller end effector including a cutting head and plumbing, the cutting head for creating a water-jet stream, the plumbing allowing for communication between the cutting head and a pump attached to a water source, the cutting head including a mixing tube for mixing abrasive and water to create an abrasive water-jet wherein the cutting head is manufactured from a material in the group consisting of a crystal jewel, sapphire, ruby, and diamond; and (b.) a numerically controlled apparatus for placing the water-jet driller end effector within a region of the hole to be drilled, the numerically controlled apparatus being a structurally mountable apparatus for placing and securing the water-jet driller end effector within a region of the hole to be drilled, the structurally mountable apparatus communicating with the agile water-jet driller end effector, the structurally mountable apparatus is attached to an airframe with temporary standoff anchors.

12. The portable numerically controlled water-jet driller of claim 11, wherein the the cutting head is manufactured from an artificial ruby made by fusing chromium sesquioxide and powdered alumina.

13. A portable numerically controlled water-jet driller for drilling a hole, the portable numerically controlled water-jet driller comprising:

(a) an agile water-jet driller end effector wherein water pressure of water exiting the agile water-jet driller end effector is greater than about 30,000 psi and cutting force less than about three pounds, the agile water driller end effector being an abrasive water-jet driller wherein garnet is used as an abrasive, the garnet having mesh size from about 50 mesh to about 120 mesh, the agile water-jet driller end effector including a cutting head and plumbing, the cutting head for creating a water-jet stream, the plumbing allowing for communication between the cutting head and a pump attached to a water source, the cutting head including a mixing tube for mixing abrasive and water to create an abrasive water-jet, wherein the cutting head is manufactured from an artificial ruby made by fusing chromium sesquioxide and powdered alumina; and (b.) a numerically controlled apparatus for placing the water-jet driller end effector within a region of the hole to be drilled, the numerically controlled apparatus being a structurally mountable apparatus for placing and securing the water-jet driller end effector within a region of the hole to be drilled, the structurally mountable apparatus communicating with the agile water-jet driller end effector, the structurally mountable apparatus is attached to an airframe with compliant suction cups.

14. A portable numerically controlled water-jet driller for drilling a hole, the portable numerically controlled water-jet driller comprising:

(a.) an agile water-jet driller end effector wherein water pressure of water exiting the agile water-jet driller end effector is greater than about 30,000 psi and cutting force less than about three pounds, the agile water driller end effector being an abrasive water-jet driller wherein garnet is used as an abrasive, the garnet having mesh size from about 50 mesh to about 120 mesh, the agile water-jet driller end effector including a cutting head and plumbing, the cutting head for creating a water-jet stream, the plumbing allowing for communication between the cutting head and a pump attached to a water source, the cutting head including a mixing tube for mixing abrasive and water to create an abrasive water-jet, wherein the cutting head is manufactured from a material in the group consisting of a crystal jewel, sapphire, ruby, and diamond; and (b.) a numerically controlled apparatus for placing the water-jet driller end effector within a region of the hole to be drilled, the numerically controlled apparatus being a structurally mountable apparatus for placing and securing the water-jet driller end effector within a region of the hole to be drilled, the structurally mountable apparatus communicating with the agile water-jet driller end effector, the structurally mountable apparatus is attached to an airframe with compliant suction cups.

* * * * *